US010145599B2

(12) United States Patent
Park et al.

(10) Patent No.: US 10,145,599 B2
(45) Date of Patent: Dec. 4, 2018

(54) REFRIGERATOR HAVING A CONTROLLER FOR EXECUTING A LOAD MATCH OPERATION, AND A CONTROL METHOD THEREOF

(71) Applicant: LG ELECTRONICS INC., Seoul (KR)

(72) Inventors: Shinhyun Park, Seoul (KR); Buhwan Ahn, Seoul (KR); Sangil Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 175 days.

(21) Appl. No.: 15/061,749

(22) Filed: Mar. 4, 2016

(65) Prior Publication Data

US 2016/0265829 A1 Sep. 15, 2016

(30) Foreign Application Priority Data

Mar. 9, 2015 (KR) ..... 10-2015-0032662

(51) Int. Cl.
*F25B 49/02* (2006.01)
*F25D 11/00* (2006.01)

(52) U.S. Cl.
CPC ..... *F25B 49/022* (2013.01); *F25D 11/00* (2013.01); *F25B 2400/052* (2013.01); *F25B 2400/054* (2013.01); *F25B 2600/02* (2013.01); *F25B 2700/2104* (2013.01)

(58) Field of Classification Search
CPC ..... F25B 49/022; F25B 2700/2104; F25B 2600/02; F25B 2600/025; F25B 2600/0253; F25B 2313/0314; F25B 2700/21171; F25B 2600/0251
See application file for complete search history.

(56) References Cited

U.S. PATENT DOCUMENTS 6,769,265 B1 * 8/2004 Davis ..... F25D 17/065 62/187
8,499,574 B2 * 8/2013 Suzuki ..... F25B 49/022 62/228.1
2002/0194856 A1 * 12/2002 Yeo ..... B01F 3/0407 62/69
2009/0105884 A1 * 4/2009 Kaga ..... F25B 49/025 700/275

(Continued)

FOREIGN PATENT DOCUMENTS

KR 10-2002-0076421 A 10/2002
KR 10-2011-0087465 A 8/2011

*Primary Examiner* — Frantz Jules
*Assistant Examiner* — Nelson Nieves
(74) *Attorney, Agent, or Firm* — Dentons US LLP

(57) ABSTRACT

The disclosure relates to a refrigerator which includes a compressor capable of generating cooling capacity for executing at least one of a refrigerating operation and a freezing operation, a temperature sensor capable of sensing an internal temperature of the refrigerator, to which cold air is supplied, at a specific period, in response to at least one of the freezing operation and the refrigerating operation, and a controller capable of calculating a rate of change in the internal temperature using the sensed internal temperature, and controlling the cooling capacity of the compressor based on the calculated rate of change in the internal temperature.

18 Claims, 7 Drawing Sheets

(56) References Cited

U.S. PATENT DOCUMENTS

| | | | | |
|---|---|---|---|---|
| 2010/0082160 | A1* | 4/2010 | Kondou | F25B 49/025 700/275 |
| 2014/0260377 | A1* | 9/2014 | Gomes | F25B 49/022 62/115 |

* cited by examiner

REFRIGERATOR HAVING A CONTROLLER FOR EXECUTING A LOAD MATCH OPERATION, AND A CONTROL METHOD THEREOF

CROSS-REFERENCE TO RELATED APPLICATION

Pursuant to 35 U.S.C. § 119(a), this application claims the benefit of earlier filing date and right of priority to Korean Application No. 10-2015-0032662, filed in Republic of Korea on Mar. 9, 2015, the contents of which is incorporated by reference herein in its entirety.

BACKGROUND OF THE INVENTION

1. Field of the Invention

This specification relates to a refrigerator, and more particularly, an apparatus for optimizing cooling capacity of a compressor based on heat load within a refrigerator, and a method for controlling the same.

2. Background of the Invention

The present invention relates to an apparatus for executing a refrigerant collecting operation in a refrigerator, and a method for controlling the same, and more particularly, an apparatus and method for collecting a remnant refrigerant within at least one evaporator of a refrigerator, in which at least one compressor and the at least one evaporator form a refrigeration cycle.

In general, a refrigerant of low temperature flows through an evaporator of a refrigerator. During this, air around the evaporator changes into cold air of low temperature due to heat-exchange with the refrigerant of the low temperature flowing through the inside of the evaporator. The cold air of the low temperature is supplied into a freezing chamber and a refrigerating chamber to execute a cooling function and then introduced back into the evaporator. Such circulation is repetitively executed. That is, the refrigerator is an apparatus of keeping an inside thereof at low temperature by using a refrigeration cycle device including a compressor, a condenser, an expansion apparatus and an evaporator.

Specifically, a controller of the refrigerator executes a load match operation by controlling an operation of the compressor based on a preset cooling capacity map. However, the conventional cooling capacity map is designed in a fixed manner according to notches of a refrigerating chamber and a freezing chamber and external air temperature. That is, the conventional method of executing the load match operation requires to set a cooling capacity map separately for each refrigerator model.

Also, in the control method for the refrigerator executing the load match operation based on the fixed cooling map, an optimized refrigerant collecting operation cannot be executed for a compressor having a different functionality for each refrigerant model, which results in excessive power consumption.

SUMMARY OF THE INVENTION

Therefore, an aspect of the detailed description is to provide a refrigerator capable of executing a load match operation optimized for an attribute thereof, and a method for controlling the same.

Another aspect of the detailed description is to provide a method for controlling a refrigerator, capable of reducing power consumption caused by a load match operation.

To achieve these and other advantages and in accordance with the purpose of this specification, as embodied and broadly described herein, there is provided a refrigerator including a compressor capable of generating cooling capacity for executing at least one of a refrigerating operation and a freezing operation, a temperature sensor capable of sensing an internal temperature of the refrigerator, to which cold air is supplied, at a specific period, in response to at least one of the freezing operation and the refrigerating operation, and a controller capable of calculating a rate of change in the internal temperature using the sensed internal temperature, and controlling the cooling capacity of the compressor based on the calculated rate of change in the internal temperature.

In one embodiment of the present invention, the refrigerator may further include a memory. The controller may control the memory to store first information related to a cooling capacity value of the compressor at a time point that the at least one of the freezing operation and the refrigerating operation is terminated, and set the cooling capacity of the compressor, using the stored first information related to the cooling capacity, at a time point that the at least one of the freezing operation and the refrigerating operation is restarted.

In one embodiment of the present invention, the controller may decrease the cooling capacity of the compressor by a first cooling capacity value when the calculated rate of change in the internal temperature is within a first range, maintain the cooling capacity of the compressor when the calculated rate of change in the internal temperature is within a second range, increase the cooling capacity of the compressor by the first cooling capacity value when the calculated rate of change in the internal temperature is within a third range, and increase the cooling capacity of the compressor by a second cooling capacity value greater than the first cooling capacity value when the calculated rate of change in the internal temperature is within a fourth range.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Figure 1:
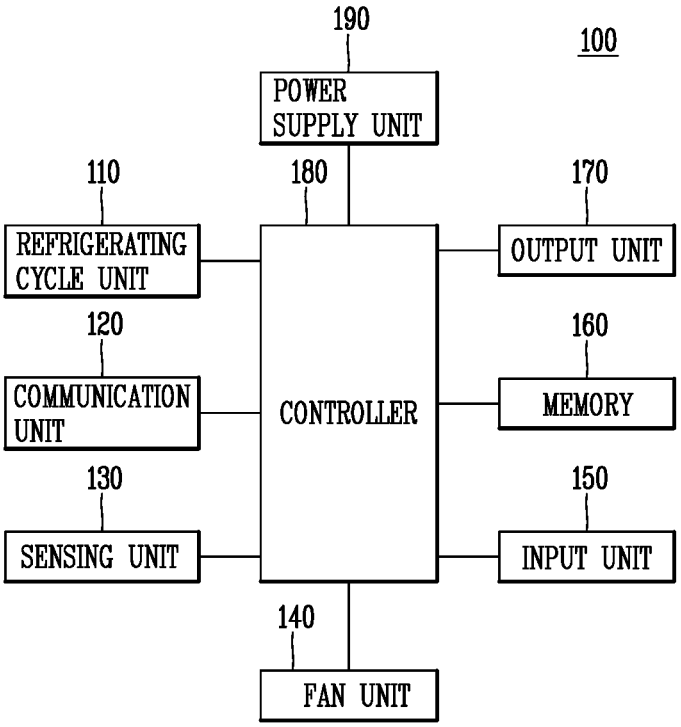
FIG. 1 is a block diagram of one exemplary embodiment of a refrigerator in accordance with the present invention.

Hereinafter, the present invention will be described in detail with reference to the accompanying drawings, and the same or similar elements are designated with the same numeral references regardless of the numerals in the drawings and their redundant description will be omitted. Incidentally, unless clearly used otherwise, expressions in the singular number include a plural meaning.

FIG. 1 illustrates a configuration of a refrigerator in accordance with the present invention.

As illustrated in FIG. 1, a refrigerator 100 according to the present invention may include at least one of a refrigeration cycle unit 110, a communication unit 120, a sensing unit 130, a fan unit 140, an input unit 150, a memory 160, an output unit 170, a controller 180 and a power supply unit 190.

It is understood that implementing all of the illustrated components of the refrigerator 100 illustrated in FIG. 1 is not a requirement, and that greater or fewer components may alternatively be implemented.

In more detail, the refrigeration cycle unit 110 may include a compressor, a condenser, an expansion apparatus, a drier, a capillary tube, a hot line and the like. In addition, the refrigeration cycle unit 110 may be configured such that a refrigerant can circulate therein according to an operation of the compressor.

For example, the refrigeration cycle unit 110 may include a single compressor, a single condenser and a single evaporator.

In another example, the refrigeration cycle unit 110 may include a single compressor, a single condenser and a plurality of evaporators. In this instance, the plurality of evaporators may be connected in parallel.

As another example, the refrigeration cycle unit 110 may include a first refrigeration cycle and a second refrigeration cycle independent of the first refrigeration cycle. In this instance, each of the first and second refrigeration cycles may include a compressor, a condenser, an evaporator and the like. Also, one of the first and second refrigeration cycles may include a hot line.

The communication unit 120 may include at least one component which performs wired or wireless communications between the refrigerator 100 and a wired or wireless communication system or between the refrigerator 100 and a network in which the refrigerator 100 is located. For example, the communication unit 120 may include a broadcast receiving module, a wireless Internet module, a short-range communication module, a location information module and the like.

The wireless Internet module included in the communication unit 120 may refer to a module which is configured to facilitate wireless Internet access. The wireless Internet module may be internally or externally coupled to the refrigerator 100. Here, examples of wireless Internet technologies may include Wireless LAN (WLAN), Wireless Fidelity (Wi-Fi), Wireless Broadband (WiBro), Worldwide Interoperability for Microwave Access (WiMAX), High Speed Downlink Packet Access (HSDPA), and the like.

The short-range communication module included in the communication unit 120 may refer to a module which is configured to facilitate short-range communications. Examples of short-range communication technologies may include BLUETOOTH™, Radio Frequency IDentification (RFID), Infrared Data Association (IrDA), Ultra-WideBand (UWB), ZigBee, and the like.

The location information module included in the communication unit 120 may be a module configured to detect, calculate, derive or otherwise identify a position of the refrigerator. The location information module may include a Global Position System (GPS) module, for example. The GPS module may receive location information from a plurality of satellites. Here, the location information may include coordinate information represented by latitude and longitude values. For example, the GPS module may measure an accurate time and distance from three or more satellites, and accurately calculate a current location of the mobile communication terminal according to trigonometry on the basis of the measured time and distances. A three satellites and performing error correction with a single satellite may be used. In particular, the GPS module may acquire an accurate time together with three-dimensional speed information as well as the location of the latitude, longitude and altitude values from the location information received from the satellites.

The communication unit 120 may receive data from a user and transmit information processed in the controller 180 of the refrigerator 100, information sensed through the sensing unit 130 and the like to an external terminal (not illustrated).

The sensing unit 130 may sense internal or external temperature of a storage chamber of the refrigerator, opening or closing of a refrigerator door or a home bar door.

In more detail, the sensing unit 130 may include at least one sensor attached to one surface within a refrigerating chamber of the refrigerator, at least one sensor attached to one surface within a freezing chamber, and at least one sensor attached to one of outer wall surfaces of the refrigerator to sense external air temperature.

Also, the sensing unit 130 may include a sensor to sense temperature of at least one of an inlet and an outlet of the evaporator. The sensing unit 130 may also include a sensor to sense an operation or non-operation of the compressor, and a cooling capacity value of the compressor. Information sensed through the sensing unit 130 may be transferred to the controller 180.

The fan unit 140 may include a cooling fan to supply cold air into the refrigerator, a radiation fan disposed in a machine room for radiating a refrigerant passing through the condenser of the refrigeration cycle unit. A turn-on/off control or an output setting control of the fan unit 140 may be executed by the controller 180 of the refrigerator 100.

The input unit 150 may be configured to output a signal corresponding to a user's input by receiving the user's input for controlling an operation of the refrigerator 100 or checking a state of the refrigerator 100. The input unit 150 may be implemented in a form of a button or a touch pad.

In more detail, the input unit 150 may be implemented in a form of a touch screen on a display of the output unit 170 of the refrigerator 100. Also, the input unit 150 may further include a camera module that is configured to capture images of foodstuffs to be kept in the refrigerator or capturing images of barcodes or QR codes attached on the foodstuffs. Also, the input unit 150 may further include a microphone that is configured to input audio data such as user's voice.

The memory 160 may store information related to the refrigerator 100, for example, a program for driving the refrigerator 100, information set for driving the refrigerator, a refrigerator application, refrigerator status information, recipe information, foodstuff information kept in the refrigerator, user information, multimedia contents and the like, and also include icons or graphic data for indicating such information in a visual manner.

In addition, the memory 160 may store information related to a cooling capacity value of the compressor. For example, data associated with the cooling capacity value of the compressor may include at least one of data associated with an initial cooling capacity value upon an initial operation of the refrigerator, and data associated with an initial cooling capacity value upon restarting the operation of the compressor.

The memory 160 may also include at least one of information related to an installed position of the refrigerator 100, information related to at least one terminal (not illustrated) desiring to request for a position, and connection information related to a server (not illustrated). In detail, the memory 160 may also store priority-related information, such as a master or a slave, together with terminal-related information, when a plurality of terminals are registered.

The output unit 170 may be configured to output information related to the refrigerator in a visible or audible manner. The output unit 170 may include a flat display and a speaker. More particularly, the display may be implemented as a touch panel through which a user's touch input is applied.

The display of the output unit 170 may output user interface (UI) or graphic user interface (GUI) associated with an operation of the refrigerator. In more detail, the display may include at least one of a Liquid Crystal Display (LCD), a Thin Film Transistor-LCD (TFT-LCD), an Organic Light Emitting Diode (OLED) display, a flexible display, a three-dimensional (3D) display, or the like. Two or more displays may be provided according to a particular desired embodiment of the refrigerator 100. For example, a first display may be provided on one surface of a refrigerating chamber door of the refrigerator 100 or a second display may be provided on one surface of the freezing chamber door.

When the display and a sensor for sensing a touch operation (hereinafter, referred to as 'touch sensor') are overlaid in a layered manner (hereinafter, referred to as 'touch screen'), the display may be used as an input device as well as an output device. The touch sensor may have the form of, for example, a touch film, a touch sheet, a touch pad and the like.

The touch sensor may be configured to convert pressure applied to a particular portion of the display or a change in capacitance generated at a particular portion of the display into an electrical input signal. The touch sensor may be configured to detect a touch input pressure as well as a touch input position and a touch input area. When there is a touch input with respect to the touch sensor, the corresponding signal(s) are sent to a touch controller (not shown). The touch controller processes the signal(s) and transmits corresponding data to the controller 180. Accordingly, the controller 180 can recognize a touched region of the display.

The power supply unit 190 may receive external power or internal power and supply appropriate power required for operating respective elements and components under the control of the controller 180.

The controller 180 typically controls the general operations of the refrigerator 100. For example, the controller 180 may execute a freezing operation, a refrigerating operation, a stop operation, a maximum output operation, and the like.

Each component constructing the refrigerator 100 may be controlled according to a user request and/or a set condition. A system memory (not illustrated) may be installed to provide a space for storing data required for control operations, environmental settings or executed processes and the like. Also, an operation system (not illustrated) may be included to drive a hardware resource of the refrigerator 100 or exchange appropriate signals and/or information with the corresponding resource, in a manner of executing command codes of a firmware and the like.

The operation of the controller 180 or an operation of an application executed accordingly may be executed under the assumption of an appropriate relay operation of the operation system. Description of the relay operation will be omitted.

Hereinafter, the refrigeration cycle unit 110 of the refrigerator 100 according to the present invention will be described in more detail, with reference to FIGS. 2A and 2B.

Figure 2A:
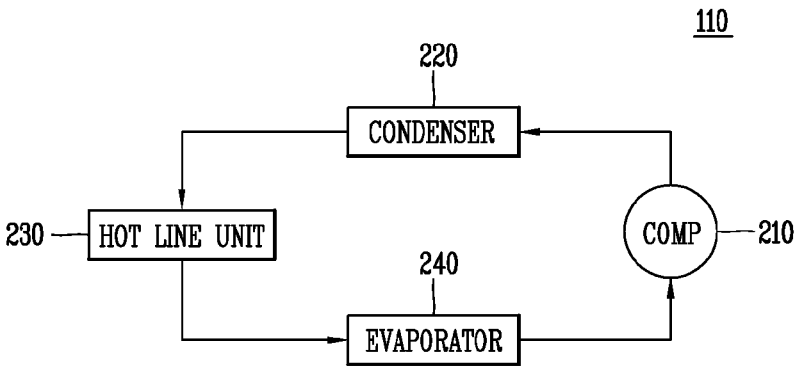
FIGS. 2A and 2B are conceptual views illustrating a refrigeration cycle of the refrigerator according to the present invention.

As illustrated in FIG. 2A, the refrigeration cycle unit 110 may include at least one of a compressor 210, a condenser 220, a hot line unit 230 and an evaporator 240.

Referring to FIG. 2A, the refrigerator according to the present invention may include the refrigeration cycle unit 110, in which a refrigerant compressed in the compressor 210 flows through the condenser 220 and then is introduced back into the compressor 220 via the hot line unit 230 and the evaporator 240. That is, the refrigerant may circulate along an inside of the refrigeration cycle unit 110.

Meanwhile, the following description will be given of an embodiment related to a refrigerator having a refrigeration cycle constructed by one compressor, one condenser and one evaporator, but the present invention may not be necessarily limited to this. That is, the configuration of the present invention can also be applied to a refrigerator executing a refrigerant collecting operation with respect to a refrigerant which is supplied in various types of refrigeration cycles which include a plurality of compressors, a plurality of evaporators and a plurality of condensers.

In more detail, the evaporator 240 may evaporate the refrigerant by heat-exchange with internal air of the refrigerator. The evaporator 240 may be connected with an evaporator inlet passage through which a refrigerant passed through a capillary tube (not illustrated) is guided into the evaporator 240. The evaporator 240 may be connected to the compressor 210 via an evaporator-compressor connecting passage. The refrigerant evaporated in the evaporator 240 may be sucked into the compressor 210 through the evaporator-compressor connecting passage. The evaporator 240 may be installed at an outer wall of an inner casing or within the inner casing.

The refrigerator may be configured as a direct-cooling type refrigerator in which an inner casing is cooled by an evaporator and a storage chamber is cooled by conduction and natural convection of internal air. The refrigerator can also be configured as an indirect-cooling type refrigerator in which an evaporator is installed outside a storage chamber and the storage chamber is cooled by forcibly circulating internal air into the storage chamber and the evaporator. The refrigerator may further include an evaporator fan (not illustrated) that is configured to blow internal air into the evaporator.

Referring to FIG. 2A, the compressor 210 may suck and compress the refrigerant evaporated in the evaporator 240 and discharge the compressed refrigerant. The compressor 210 may be connected to the condenser 220 via a compressor-condenser connecting passage. The refrigerant compressed in the compressor 210 may be guided into the condenser 220 via the compressor-condenser connecting passage. The compressor 210 may be installed in a machine room provided in the refrigerator.

The condenser 220 may condense the refrigerant compressed in the compressor 210. The condenser 220 may be connected with a condenser outlet passage through which the refrigerant passed through the condenser 220 is guided. The condenser 220 may be installed in the machine room provided in the refrigerator or installed outside the refrigerator in an exposed manner. In addition, a machine room fan may be provided in the machine room for radiating the refrigerant passed through the condenser. The machine room fan may correspond to the radiating fan for the refrigerant circulating along the refrigeration cycle.

Referring to FIG. 2A, the refrigeration cycle unit 110 may include the hot line unit 230. The hot line unit 230 may be installed to remove dew generated in the refrigerator in an evaporating manner by use of the refrigerant passed through the condenser 220. The hot line unit 230 may be provided at a contact portion between a refrigerator body and a door. The hot line unit 230 may include a refrigerant pipe which is installed at a portion of the refrigerator body which is brought into contact with the door. The hot line may be provided between an outer casing and an inner casing of the refrigerator body, and radiate heat from the refrigerant through the outer casing. A refrigerant in a gaseous state of the refrigerant passed through the condenser 220 may be condensed by being radiated through the hot line, and dew generated on the contact portion between the refrigerator body and the door can be removed by heat transferred to the hot line.

Figure 2B:
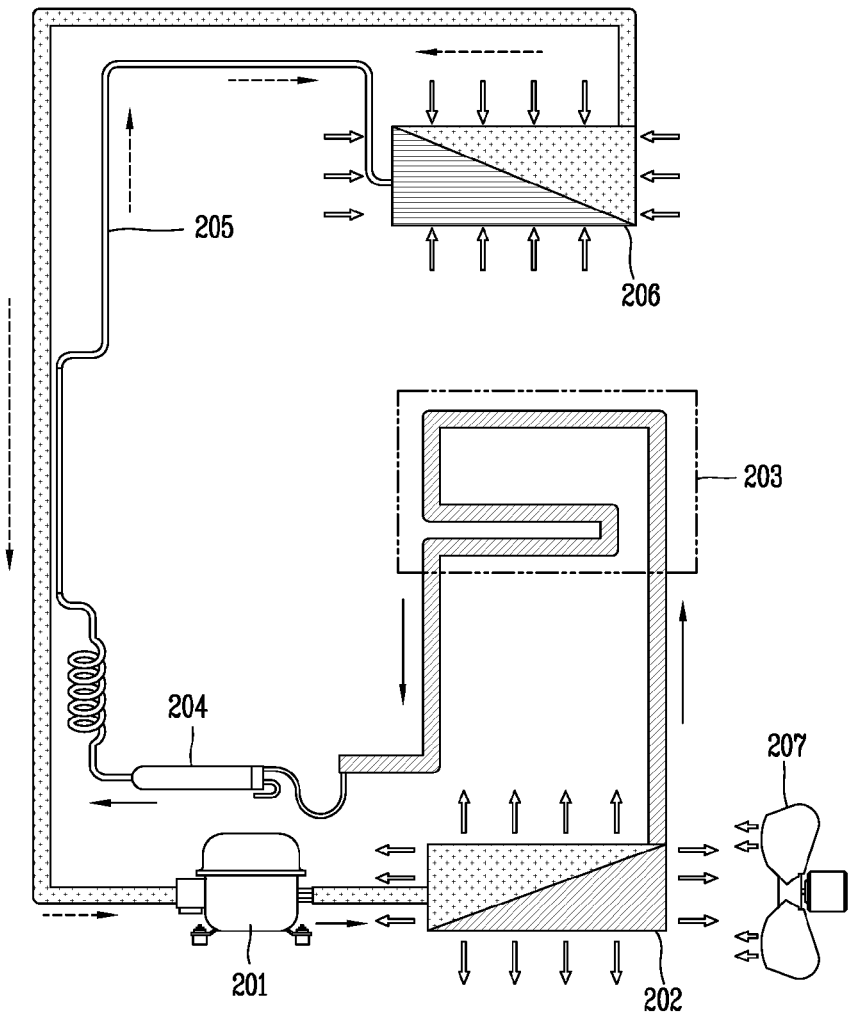

FIG. 2B is a conceptual view of a refrigeration cycle. As illustrated in FIG. 2B, a compressor 201 and a condenser 202 of a refrigeration cycle may be disposed in the machine room. Also, a refrigerant passing through the condenser 220 may be radiated by a radiating fan 207 which is disposed in the machine room. The controller 180 may control revolutions per minute (RPM) of the radiating fan 207, to adjust a radiated amount of refrigerant passing through the condenser 220.

Hereinafter, a control method for a refrigerator executing a refrigerant collecting operation according to the present invention will be described with reference to FIG. 3.

Figure 3:
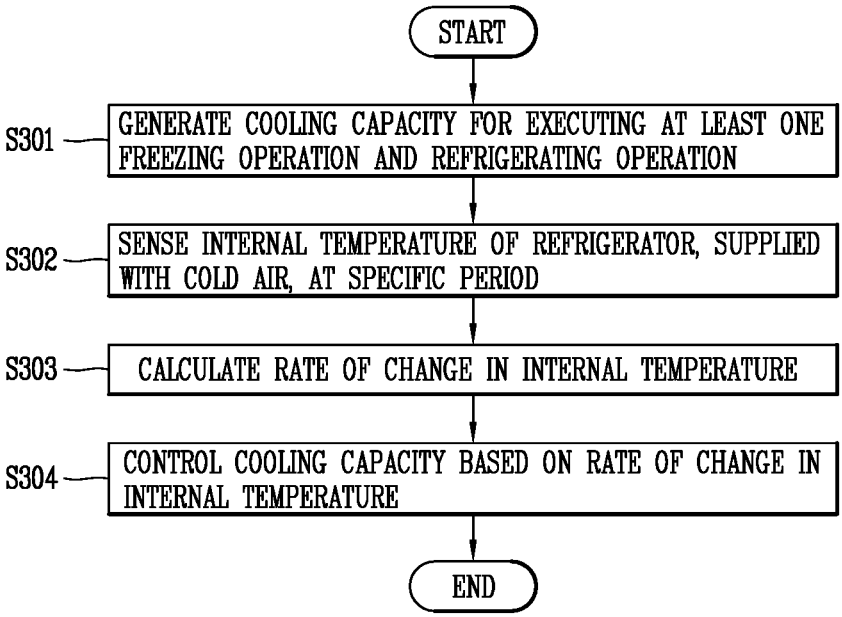
FIG. 3 is a flowchart illustrating one exemplary embodiment of a refrigerator control method in accordance with the present invention.

Referring to FIG. 3, the compressor 210 may generate cooling capacity for executing at least one of a freezing operation or a refrigerating operation (S301).

The sensing unit 130 may sense internal temperature of the refrigerator, to which cold air is supplied, at a specific period (S302).

In more detail, the sensing unit 130 may include at least one first sensor which is disposed at an inner wall of at least one of a refrigerating chamber and a freezing chamber of the refrigerator. In this instance, the at least one first sensor may sense at least one of temperature of the refrigerating chamber and temperature of the freezing chamber at a first period. The first period may be decided according to an attribute of the first sensor disposed, or set by the controller 180 in response to a user input.

Meanwhile, the sensing unit 130 may include at least one second sensor which is disposed at at least one of an inlet and an outlet of the evaporator 240. In this instance, the second sensor may be attached onto a pipe surface of at least one of the inlet and the outlet of the evaporator 240. The second sensor may sense temperature of the refrigerant passing through the evaporator 240. In addition, the controller 180 may calculate an internal temperature value of the refrigerator by using the value sensed by the second sensor.

The controller 180 may calculate a rate of change in the internal temperature of the refrigerator using the internal temperature of the refrigerator sensed through the sensing unit (S303).

In more detail, the controller 180 may calculate the rate of change in the internal temperature of the refrigerator by calculating a time interval from a first time point to a second time point at which the internal temperature is dropped by a reference temperature value.

In another example, the controller 180 may calculate the rate of change in the internal temperature of the refrigerator, by dividing a difference between a first internal temperature value and a second internal temperature value sensed at the first and second time point, respectively, by a time difference between the first and second time points.

The controller 180 may calculate the rate of change in the internal temperature of the refrigerator at every second period. In this instance, the controller 180 may set the second period based on a user input. For example, the second period may correspond to the first period at which the sensing unit 130 senses the internal temperature of the refrigerator.

Also, the controller 180 may control the cooling capacity of the compressor 210 based on the calculated rate of change in the internal temperature (S304).

In more detail, the controller 180 may reduce the cooling capacity of the compressor 210 when the calculated rate of change in the internal temperature meets a first condition, maintain the cooling capacity of the compressor 210 when the calculated rate of change in the internal temperature meets a second condition, increase the cooling capacity of the compressor 210 when the calculated rate of change in the internal temperature meets a third condition, and set the cooling capacity of the compressor as a maximum value (the highest value) when the calculated rate of change in the internal temperature meets a fourth condition.

The controller 180 may differently set an increase or decrease width of the cooling capacity of the compressor 210 based on information related to a preset internal temperature.

The controller 180 may determine a currently-activated operation mode of the refrigerator, and change the increase or decrease width of the cooling capacity of the compressor 210 or information related to the first to fourth conditions based on the determination result.

For reference, the controller 180 may change the first to fourth conditions based on a user input.

However, the controller 180 may maintain the cooling capacity of the compressor 210 even under the first condition when the compressor 210 is generating the least cooling capacity. Also, the controller 180 may maintain the cooling capacity of the compressor 210 even under the third condition when the compressor is generating the highest cooling capacity.

Figure 4:
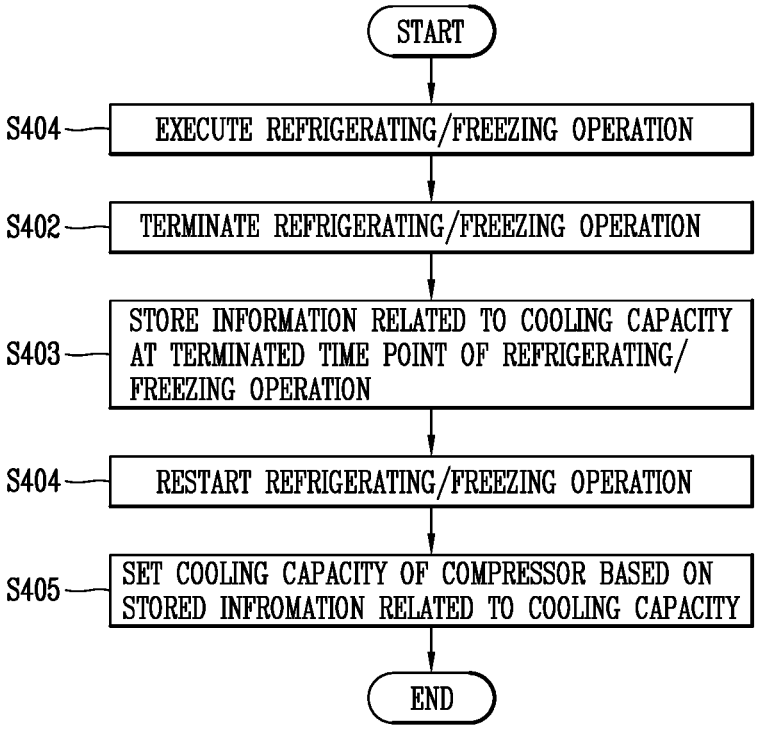
FIGS. 4 to 6 are flowcharts illustrating a detailed exemplary embodiment of the refrigerator control method illustrated in FIG. 3.

Hereinafter, description will be given of one embodiment of storing information related to a changed cooling capacity value of the compressor, in the refrigerator executing the load match operation and a control method thereof according to the present invention, with reference to FIG. 4.

The controller 180 may control the compressor 210 to execute at least one of a refrigerating operation and a freezing operation (S401).

In more detail, while at least one of the refrigerating operation and the freezing operation is currently executed, the controller 180 may decrease, increase or maintain the cooling capacity of the compressor 210 based on the rate of change in the internal temperature of the refrigerator.

Afterwards, the controller 180 may control the compressor 210 to terminate (stop) at least one of the refrigerating operation and the freezing operation (S402).

Also, the controller 180 may control the memory 160 to store first information related to the cooling capacity value of the compressor 210 at a time point when the at least one of the refrigerating operation and the freezing operation is terminated (S403).

For reference, the memory 160 may previously store second information related to an initial value of the cooling capacity of the compressor. The controller 180 may control the memory 160 to store the first information related to the cooling capacity value of the compressor at the time point when the at least one of the refrigerating operation and the freezing operation is terminated, separate from the prestored second information.

Next, the controller 180 may control the compressor 210 to restart at least one of the refrigerating operation and the freezing operation (S404).

In addition, the controller 180 may set the cooling capacity of the compressor 210 using the first information related to the stored cooling capacity value, at the restarting time point of the at least one of the refrigerating operation and the freezing operation.

Meanwhile, the controller 180 may set the cooling capacity of the compressor 210 using the second information related to the prestored initial value of the cooling capacity when at least one of the refrigerating operation and the freezing operation is initially executed.

Figure 5:
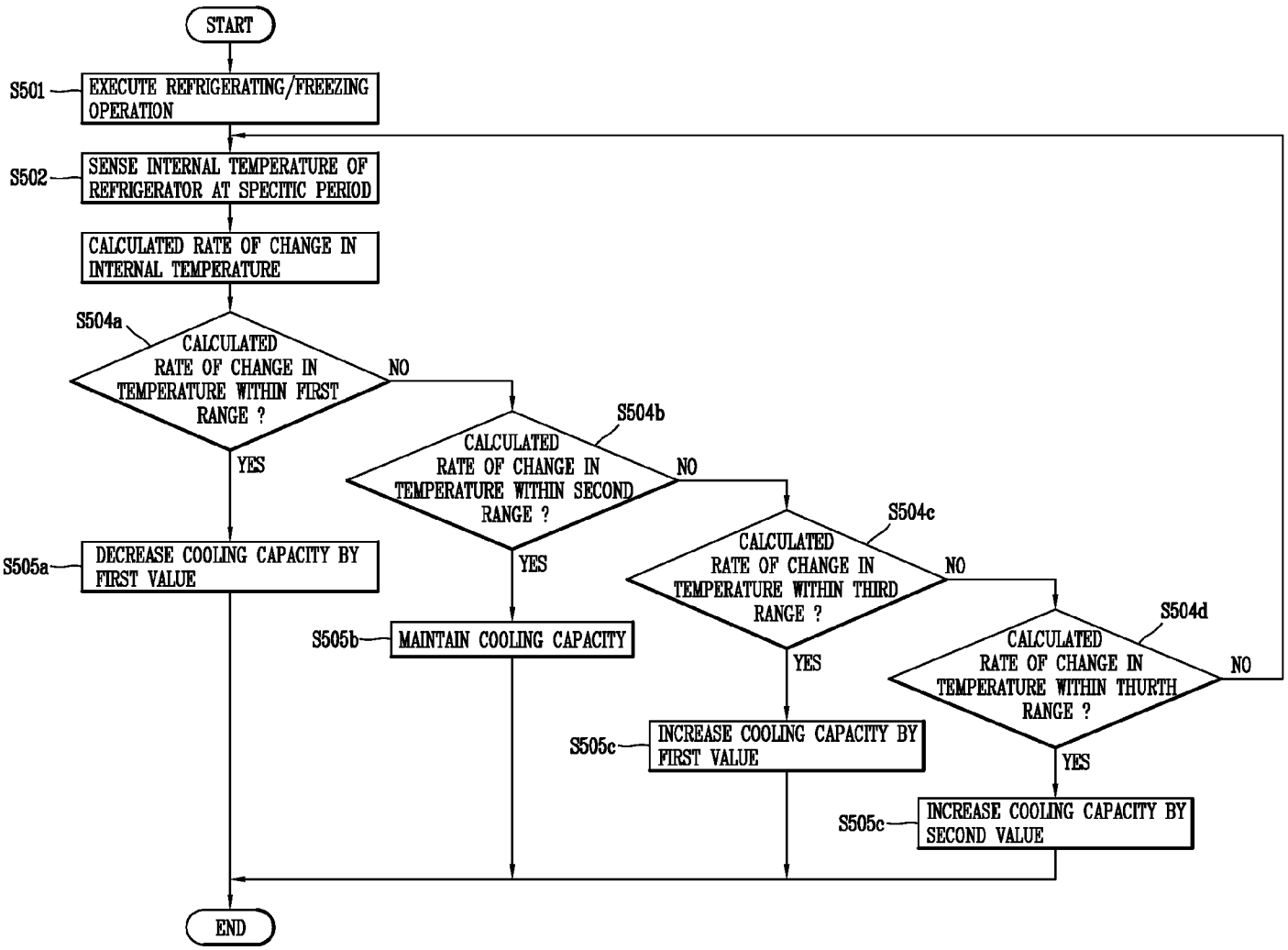

Hereinafter, description will be given of one embodiment of differently setting a changed amount of the cooling capacity of the compressor according to the calculated rate of change in the internal temperature, with reference to FIG. 5.

The controller 180 may control the compressor 210 to execute at least one of the refrigerating operation and the freezing operation (S501).

The sensing unit 130 may sense internal temperature of the refrigerator, to which cold air is supplied, at a specific period (S502).

The controller 180 may calculate a rate of change in the internal temperature of the refrigerator using the internal temperature sensed through the sensing unit 130 (S503).

In addition, the controller 180 may determine whether or not the calculated rate of change in the internal temperature is included in one of preset first to fourth ranges (S504*a*, S504*b*, S504*c* and S504*d*).

According to the determination result of the determining step (S504*a*, S504*b*, S504*c* and S504*d*), the controller 180 may reduce the cooling capacity of the compressor 210 by a first cooling capacity value (S505*a*), maintain the cooling capacity of the compressor 210 (S505*b*), increase the cooling capacity of the compressor by the first cooling capacity value (S505*c*), and increase the cooling capacity of the compressor by a second cooling capacity value which is greater than the first cooling capacity value (S505*d*).

That is, the controller 1890 may control the compressor 210 to decrease the cooling capacity by the first cooling capacity value when the calculated rate of change in the internal temperature is in the first range (S505*a*), maintain the cooling capacity when the calculated rate of change in the internal temperature is in the second range (S505*b*), increase the cooling capacity by the first cooling capacity value when the calculated rate of change in the internal temperature is in the third range (S505*c*), and increase the cooling capacity of the compressor by the second cooling capacity value which is greater than the first cooling capacity value when the calculated rate of change in the internal temperature is in the fourth range (S505*d*).

Also, the controller 180 may set the first to fourth ranges based on a user input.

The controller 180 may determine an operation mode of the refrigerator and set the first to fourth ranges based on the determination result. That is, the controller 180 may determine an execution or non-execution of at least one of the refrigerating operation and the freezing operation, and set the first to fourth ranges based on the determination result.

Also, the controller 180 may set information related to an increase or decrease width of the cooling capacity of the compressor 210 according to the operation mode of the refrigerator. That is, the controller 180 may differently set the first and second cooling capacity values during the refrigerating operation from the first and second cooling capacity values during the freezing operation.

Meanwhile, the controller 180 may calculate the rate of change in the internal temperature based on a time which is taken until the internal temperature of the refrigerator falls by a reference temperature value.

That is, the controller 180 may measure a time interval which is taken until the internal temperature of the refrigerator falls by the reference temperature value, in order to calculate the rate of change in the internal temperature. For example, the reference temperature value may be 0.1° C. In another example, the controller 180 may change the reference temperature value based on a user input.

In this instance, the controller 180 may set the information related to the first to fourth ranges in association with the time interval. Accordingly, the controller 180 can determine to which of the first to fourth ranges the measured time interval belongs.

For example, the first range may be a time from 0 to 100 seconds, the second range may be a time from 100 to 200 seconds, the third range may be a time from 200 to 300 seconds, and the fourth range may be a time from 300 to 400 seconds. That is, the controller 180 may measure a second time point when the internal temperature of the refrigerator has fallen by the reference temperature value (e.g., 0.1° C.) since the first time point, and calculate a difference between the first and second time points, thereby determining to which one of the first to fourth ranges the time difference belongs.

In addition, the controller 180 may change the reference temperature value according to the operation mode of the refrigerator. That is, the controller 180 may set a first reference temperature value as the reference temperature value when the operation mode of the refrigerator is the refrigerating operation mode, and set a second reference temperature value as the reference temperature value when the operation mode of the refrigerator is the freezing operation mode.

Hereinafter, description will be given of one embodiment related to the control method of the refrigerator executing the load match operation in case where heat load of the refrigerator drastically rises up, with reference to FIG. 6.

Figure 6:
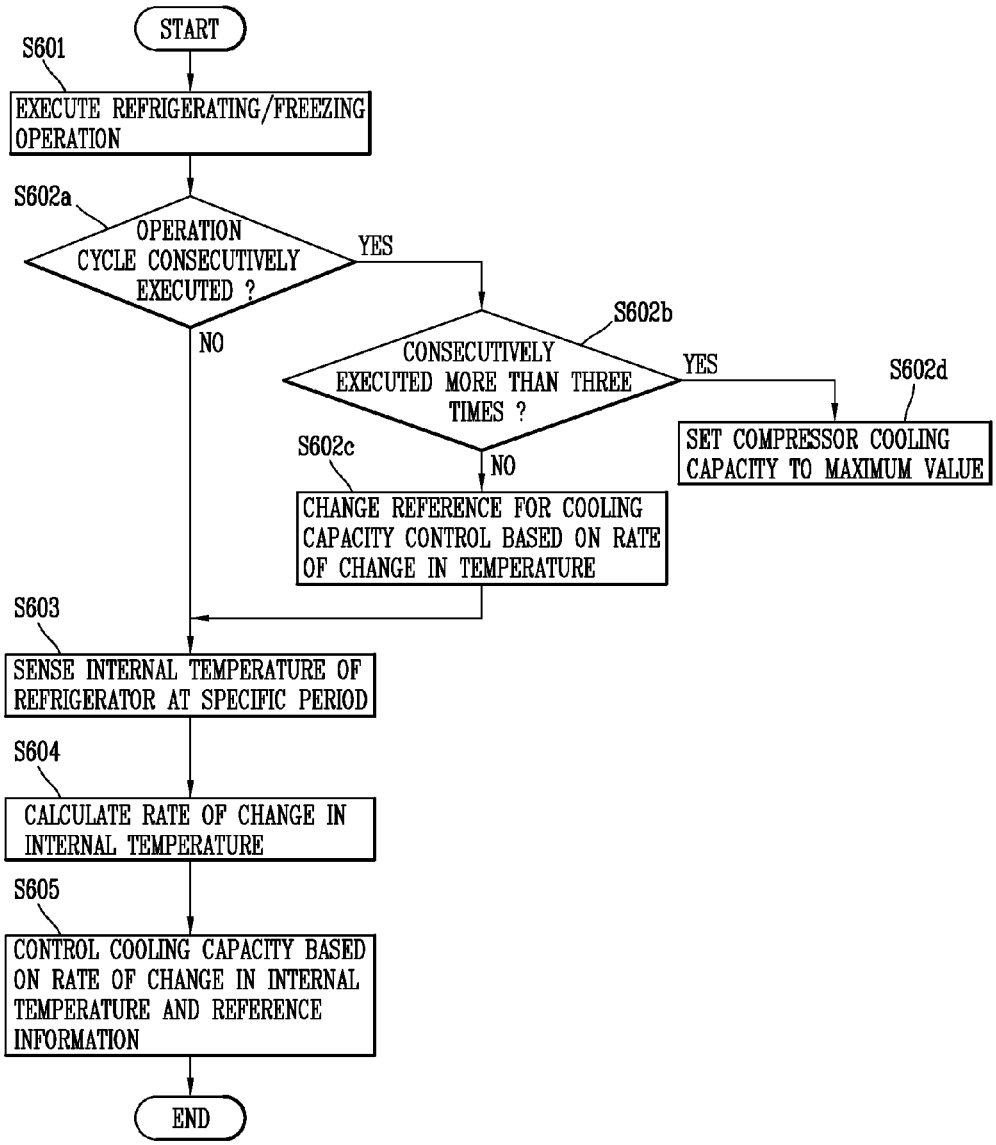

As illustrated in FIG. 6, the controller 180 may control the compressor to execute at least one of the refrigerating operation and the freezing operation (S601).

The controller 180 may determine whether or not an operation cycle which includes the refrigerating operation and the freezing operation of the compressor is consecutively executed (S602*a*).

In detail, after the refrigerating operation and the freezing operation are sequentially executed, when at least one of the refrigerating operation and the freezing operation is consecutively executed without a resting period immediately after the freezing operation is terminated, the controller 180 may determine that the operation cycle is consecutively executed.

Specifically, the controller 180 may determine whether or not a number of the consecutive execution of the operation cycle is more than three times (S602*b*).

Accordingly, when the operation cycle including the refrigerating operation and the freezing operation of the compressor is consecutively executed, the controller 180 may change the first to fourth ranges (S602*c*). That is, when the operation cycle is consecutively executed, the controller 180 may change or reset information related to a reference for the cooling capacity control based on the rate of change in temperature.

The controller 180 may also set the cooling capacity of the compressor to a maximum value when the operation cycle is consecutively executed more than a preset number of times (S602*d*). For example, the preset number of times may be three times. However, the present invention may be not necessarily limited to this embodiment, and the preset number of times may vary.

Next, the sensing unit 130 may sense the internal temperature of the refrigerator at a specific period (S603).

The controller 180 may calculate the rate of change in the internal temperature using the sensed internal temperature (S604).

The controller 180 may also control the cooling capacity of the compressor by using the changed information related to the reference and the calculated rate of change in the internal temperature (S605).

For reference, when it is determined that the operation cycle has been executed consecutively, the controller 180 may not store information related to a cooling capacity value of the compressor at a terminated time point of the consecutively-executed operation cycle and maintain first information which has been stored before the consecutively-executed operation cycle is started.

Figure 7A:
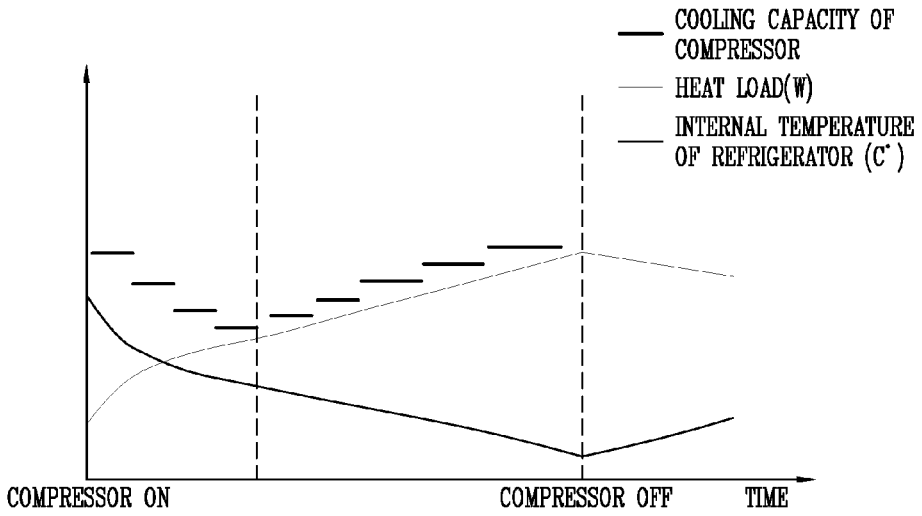
FIGS. 7A, 7B and 8 are graphs showing relationship of heat load, internal temperature, set temperature and cooling capacity of a compressor, in relation to the refrigerator according to the present invention.
Figure 7B:
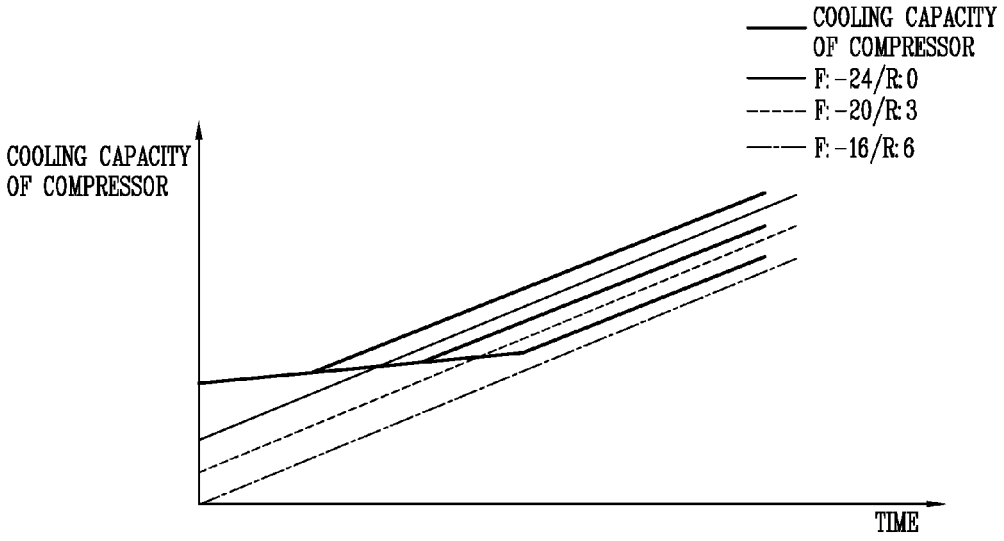
Figure 8:
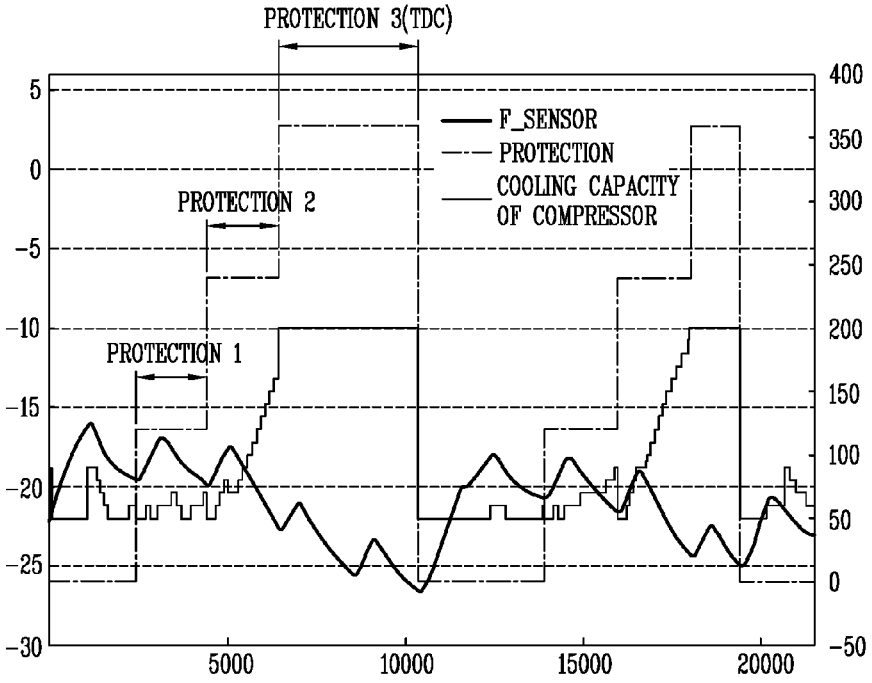

FIGS. 7A, 7B and 8 are graphs showing relationship of heat load, internal temperature, set temperature and cooling capacity of a compressor, in relation to the refrigerator executing the load match operation according to the present invention, which will now be described.

Referring to FIG. 7A, in the method for controlling the refrigerator according to the present invention, when the internal temperature of the refrigerator is a specific value, the cooling capacity of the compressor can differently be generated based on the rate of change in the internal temperature of the refrigerator, unlike the related art generating cooling capacity of a compressor in a fixed manner.

Referring to FIG. 7B, the controller 180 of the refrigerator according to the present invention may control the cooling capacity of the compressor, based on information related to an internal temperature of the refrigerator, which has been preset based on a user input, and a rate of change in the internal temperature of the refrigerator.

In addition, referring to FIG. 8, the controller 180 of the refrigerator according to the present invention may set the cooling capacity of the compressor to a maximum value when the operation cycle including the refrigerating operation and the freezing operation is consecutively executed, namely, when heat load in the refrigerator is increased more than a preset limit value within a specific time interval.

According to the present invention, even without a separate user setting based on a compressor performance with respect to various refrigerator models, an optimized load match operation can be executed, which may result in an optimization of the cooling capacity of the compressor. Therefore, according to the present invention, the optimized cooling capacity of the compressor for the load-match operation can result in minimization of a power consumption of the refrigerator.

In addition, by virtue of the optimized load match operation, an operation efficiency of the refrigerator can be enhanced, which may allow for solving a problem of insufficiently cooling or overcooling the inside of the refrigerator which is caused due to a change in heat load of the refrigerator.

It should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator comprising:

a compressor to provide a cooling capacity for at least one of a refrigerating operation and a freezing operation;

a temperature sensor to sense an internal temperature of the refrigerator at a specific period in response to at least one of the freezing operation and the refrigerating operation; and a controller to receive the sensed internal temperature from the temperature sensor, calculate a rate of change in the internal temperature using the sensed internal temperature, and control the cooling capacity of the compressor based on the calculated rate of change in the internal temperature, wherein the controller:

decreases the cooling capacity of the compressor by a first cooling capacity value when the rate of change in the internal temperature is within a first range, maintains the cooling capacity of the compressor when the rate of change in the internal temperature is within a second range, increases the cooling capacity of the compressor by the first cooling capacity value when the rate of change in the internal temperature is within a third range, and increases the cooling capacity of the compressor by a second cooling capacity value that is greater than the first cooling capacity value when the rate of change in the internal temperature is within a fourth range, wherein the controller changes the first, second, third, and fourth ranges when an operation cycle including the refrigerating operation and the freezing operation of the compressor is consecutively executed more than a preset number of times.

2. The refrigerator of claim 1, further comprising:

a memory to store first information related to a cooling capacity value of the compressor when the at least one of the freezing operation and the refrigerating operation is stopped, wherein the controller sets the cooling capacity of the compressor based on the stored first information when the at least one of the freezing operation and the refrigerating operation is restarted.

3. The refrigerator of claim 1, wherein the controller calculates the rate of change in the internal temperature based on an amount of time taken for the internal temperature to decrease by a preset temperature value.

4. The refrigerator of claim 1, further comprising:

an input unit to receive a user input for at least one internal temperature of the refrigerator, wherein the controller sets the first, second, third, and fourth ranges based on the user input.

5. The refrigerator of claim 1, wherein the controller determines execution or non-execution of each of the refrigerating operation and the freezing operation, and sets the first, second, third, and fourth ranges and the first and second cooling capacity values based on the determination result.

6. The refrigerator of claim 1, wherein the controller changes the first, second, third, and fourth ranges when an operation cycle including the refrigerating operation and the freezing operation of the compressor is consecutively executed.

7. The refrigerator of claim 6, wherein the controller sets the cooling capacity of the compressor to a maximum value when the operation cycle is consecutively executed more than a preset number of times.

8. The refrigerator of claim 7, wherein the preset number of times is three times.

9. The refrigerator of claim 6, wherein the controller sets the cooling capacity of the compressor using first information stored before the consecutively-executed operation cycle is started, when at least one of the refrigerating operation and the freezing operation is restarted after a predetermined time interval after the consecutively-executed operation cycle is stopped.

10. The refrigerator of claim 1, wherein the calculated rate of change in the internal temperature is determined based on a measurement of a time interval for the internal temperature of the refrigerator to decrease by a reference temperature value.

11. The refrigerator of claim 10, wherein the reference temperature value is 0.1° C.

12. The refrigerator of claim 10, wherein the controller changes the reference temperature value based on a user input.

13. The refrigerator of claim 10, wherein the controller changes the reference temperature value based on an operation mode of the refrigerator.

14. A method for controlling a refrigerator, the method comprising:

generating, using a compressor, a cooling capacity for executing at least one of a freezing operation and a refrigerating operation of the refrigerator;

sensing, using a temperature sensor, an internal temperature of the refrigerator at a predetermined period;

calculating, using a controller, a rate of change in the internal temperature using the internal temperature; and controlling, using the controller, the cooling capacity of the compressor based on the rate of change in the internal temperature, wherein the controlling the cooling capacity of the compressor comprises:

decreasing the cooling capacity of the compressor by a first cooling capacity value when the rate of change in the internal temperature is within a first range, maintaining the cooling capacity of the compressor when the rate of change in the internal temperature is within a second range, increasing the cooling capacity of the compressor by the first cooling capacity value when the rate of change in the internal temperature is within a third range, and increasing the cooling capacity of the compressor by a second cooling capacity value that is greater than the first cooling capacity value when the rate of change in the internal temperature is within a fourth range, changing the first, second, third, and fourth ranges when an operation cycle including the refrigerating operation and the freezing operation of the compressor is consecutively executed more than a preset number of times.

15. The method of claim 14, further comprising:

storing, using a memory, first information related to a cooling capacity value of the compressor when at least one of the freezing operation and the refrigerating operation is stopped; and setting, using the controller, the cooling capacity of the compressor based on the stored first information when at least one of the freezing operation and the refrigerating operation is restarted.

16. The method of claim 14, further comprising calculating the rate of change in the internal temperature based on an amount of time taken for the internal temperature to decrease by a preset temperature value.

17. The method of claim 14, further comprising:

determining execution or non-execution of each of the refrigerating operation and the freezing operation; and setting the first, second, third, and fourth ranges and the first and second cooling capacity values based on the determination result.

18. The method of claim 14, further comprising changing the first, second, third, and fourth ranges when an operation cycle including the refrigerating operation and the freezing operation of the compressor is consecutively executed.

* * * * *